US005330333A

United States Patent [19]

Holmes

[11] Patent Number: 5,330,333

[45] Date of Patent: Jul. 19, 1994

[54] INDEXING ROTARY ACTUATOR WITH CLUTCH PISTONS

[76] Inventor: Greg Holmes, Teakwood Dr., Rte. 10 Box 318-62, Winston Salem, N.C. 27127

[21] Appl. No.: 34,423

[22] Filed: Mar. 19, 1993

[51] Int. Cl.[5] ..... F01C 1/00; F01C 21/00; F03C 2/00

[52] U.S. Cl. ..... 418/35; 418/186

[58] Field of Search ..... 418/35, 186

[56] References Cited

U.S. PATENT DOCUMENTS

| | | | |
|---|---|---|---|
| 1,212,649 | 1/1917 | Krikorian | 418/35 |
| 1,250,569 | 12/1917 | Desmond . | |
| 2,657,676 | 11/1953 | Mallinckrodt | 418/35 |
| 2,974,645 | 3/1961 | Wik . | |
| 3,155,013 | 11/1964 | Rumsey . | |
| 3,186,383 | 6/1965 | Potter | 418/35 |
| 3,446,120 | 11/1969 | Sneen . | |
| 3,995,536 | 12/1976 | Tenfjord . | |
| 4,000,959 | 1/1977 | Portugali | 418/35 |
| 4,132,078 | 1/1979 | Akeret . | |
| 4,319,551 | 3/1982 | Rubinshtein | 418/35 X |

FOREIGN PATENT DOCUMENTS

| | | | |
|---|---|---|---|
| 2934800 | 3/1981 | Fed. Rep. of Germany | 418/35 |

OTHER PUBLICATIONS

"Shape-Memory Wires Switch Rotary Actuator" by M. J. Brudnicki, NASA Technical Briefs, Jul. 1992, pp. 72 and 73.

"Designing Energy-Efficient Pneumatic Circuits" by H. Fleischer, Hydraulics and Pneumatics, Jun. 1991 pp. 38 and 39.

"Goal for Fluid Power in the 1990's" by Dr. E. C. Fitch et al, Hydraulics and Pneumatics, Jan. 1992, pp. 71, 72 and 74.

*Primary Examiner*—Edward K. Look
*Assistant Examiner*—John Ryznic

[57] ABSTRACT

An indexing rotary actuator is provided for unidirectionally rotating an output shaft through a specific angle per each indexing operation accurately without cumulative error. A pair of symmetrical housing members are mounted together to form an actuator housing. Within the actuator housing are formed a main piston chamber and a clutch piston chamber. Within the clutch piston chamber, a pair of piston mounting rings are mounted opposing each other, wherein a pair of respective main pistons within the main piston chamber are affixed to outer diametrical surfaces of the piston mounting rings. Furthermore, a pair of clutch pistons are provided within the clutch piston chamber slidably supported along the output shaft within the clutch piston chamber. The main pistons are air or fluid powered to be rotatable about the annular main piston chamber. The opposing faces of the piston mounting rings include respective raised arcuate sectors which are cooperable to limit rotation of the main pistons within the main piston chamber through the specified angle per each indexing operation, thus limiting rotation of the output shaft. Application of pressurized air or fluid through inlet ports within a first or second end of the actuator housing serves to drive the main pistons within the main piston chamber and to drive the clutch pistons along the output shaft within the main chamber. The clutch pistons are therefore alternately engaged with the output shaft, thus alternately translating rotational energy of the main pistons to the output shaft.

8 Claims, 6 Drawing Sheets 10R
11
39
38
2
10L
45
15
P3
36
31
X
P1
18,19
13
43
12
34
49
G1
P2
C4
P2'
Y
P1'
32
17
44
35
25
36
13
29
33
27
21
22
41
14
11
40
20
45
2
30
26
24
28

INDEXING ROTARY ACTUATOR WITH CLUTCH PISTONS

BACKGROUND OF THE INVENTION

1. Field of the Invention

The present invention relates to an indexing rotary actuator which is preferably used in industry for automation of rotary motion of indexing conveyors and rotary indexers.

2. Description of the Background Art

Fluid or air-powered rotary actuators are commonly used in industry for automation of rotary motion. Four conventional rotary actuator types include a vane type, a piston type with rack and pinion, a piston type with a lever actuated shaft, and a piston type with a chain and sprocket. Vane type actuators use fluid power to force a vane, which is fastened to an output shaft, to rotate through an arc less than 360°. The output shaft of the vane type rotary actuator must reciprocate to be reset to the start position.

The piston type rotary actuator with rack and pinion utilizes linear double acting piston motion to actuate the rack and pinion mechanism wherein the output shaft is fastened to the pinion. Angular displacement generally up to 360° may be achieved. Reciprocation is necessary to reset the rotary actuator shaft to the start position. The piston type rotary actuator with lever activated shaft utilizes linear piston motion to actuate the lever mechanism which rotates the output shaft. Angular displacements are usually 180° or less. Reciprocation is necessary to reset the rotary actuator to the start position. The piston type rotary actuator with chain and sprocket utilizes linear piston motion to actuate the chain and sprocket mechanism, wherein the output shaft is fastened to the sprocket. This type of rotary actuator provides angular displacements up to five full revolutions. Reciprocation is necessary to reset the rotary actuator to the start position.

A variation of the piston type rotary actuator with rack and pinion as described above uses a pawl and ratchet mechanism together with roller bearing/cam clutches, which transmit torque in one direction and which run freely in the reverse direction. This permits the rack and pinion to drive the output shaft through a fixed angular displacement in the same direction each time the unit is cycled. While the linear piston completes a full return stroke, the output shaft remains stationary due to the roller bearing/cam clutch. Available angular displacements are limited to simple fractions of a whole revolution, from about 30° to 360° per step.

All of the above mentioned rotary actuators, with the exception of the piston-type rotary actuator with rack and pinion variation described above, require additional mechanical elements such as pawls and ratchets to attain positional accuracy necessary for complete rotary and linear indexing. Consequently, the requirement of additional mechanical elements increases manufacturing costs of the conventional rotary actuators. Furthermore, the pawls and ratchets are subject to mechanical wear which decreases accuracy of indexing and which eventually results in system failure. In the piston type rotary actuator with rack and pinion variation described above, the additional mechanical elements are disposed internally within the rotary indexer. System repair is difficult and costly.

A further disadvantage of conventional rotary actuators as described above is energy inefficiency. The conventional systems require that the main motive source, either the vane or piston, completes a full return stroke during which no work is done. Accordingly, the conventional rotary actuators are 50% efficient at best.

SUMMARY OF THE INVENTION

An object of the present invention is to provide an indexing rotary actuator of increased efficiency which requires no return stroke for resetting of the actuator.

An further object of the present invention is to provide an indexing rotary actuator which accurately indexes an output shaft through a desired range with no cumulative error.

A still further object of the present invention is to provide an indexing rotary actuator which does not require mechanical elements such as ratchets, pawls or one-way clutches for single direction rotary and linear indexing.

The above described objects of the present invention are fulfilled by providing an indexing rotary actuator including a pair of symmetrical identical housing members mounted together to form an actuator housing wherein an output shaft of the indexing rotary actuator is indexed in a single direction through a specific angle per each indexing operation. A main piston chamber is disposed annularly within the actuator housing. Main pistons are driven by pressurized air or fluid to be rotatable about the main piston chamber. A clutch piston chamber is also disposed within the actuator housing and includes clutch pistons. Piston mounting rings are mounted within the clutch piston chamber with respective first faces opposing each other. The main pistons are respectively affixed to an outer peripheral surface of the piston mounting rings and are rotatable within the clutch piston chamber. The clutch pistons are mounted to oppose respective second faces of the piston mounting rings and are slidably supported within the clutch piston chamber along the output shaft toward and away from the piston mounting rings. Passageways are provided through the clutch pistons, piston mounting rings and main pistons so that the main pistons can be driven within the main piston chamber by force of pressurized air or fluid. The piston mounting rings include raised arcuate sectors formed upon the first faces which limit rotation of the main pistons around the central axis of the indexing rotary actuator, thus limiting rotation of the output shaft through the specific angle for each indexing.

Successive single-direction indexing operations of the output shaft are achieved by alternate application of pressurized air or fluid through the clutch pistons and the piston mounting rings to the respective main pistons. Therefore, reciprocation to reset the indexing rotary actuator is avoided, resulting in increased efficiency as compared to the conventional rotary actuators.

In a preferred embodiment of the present invention, the raised arcuate sectors are formed as 90° sectors. Furthermore, the specific angle of rotation of the output shaft is 180°.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1:
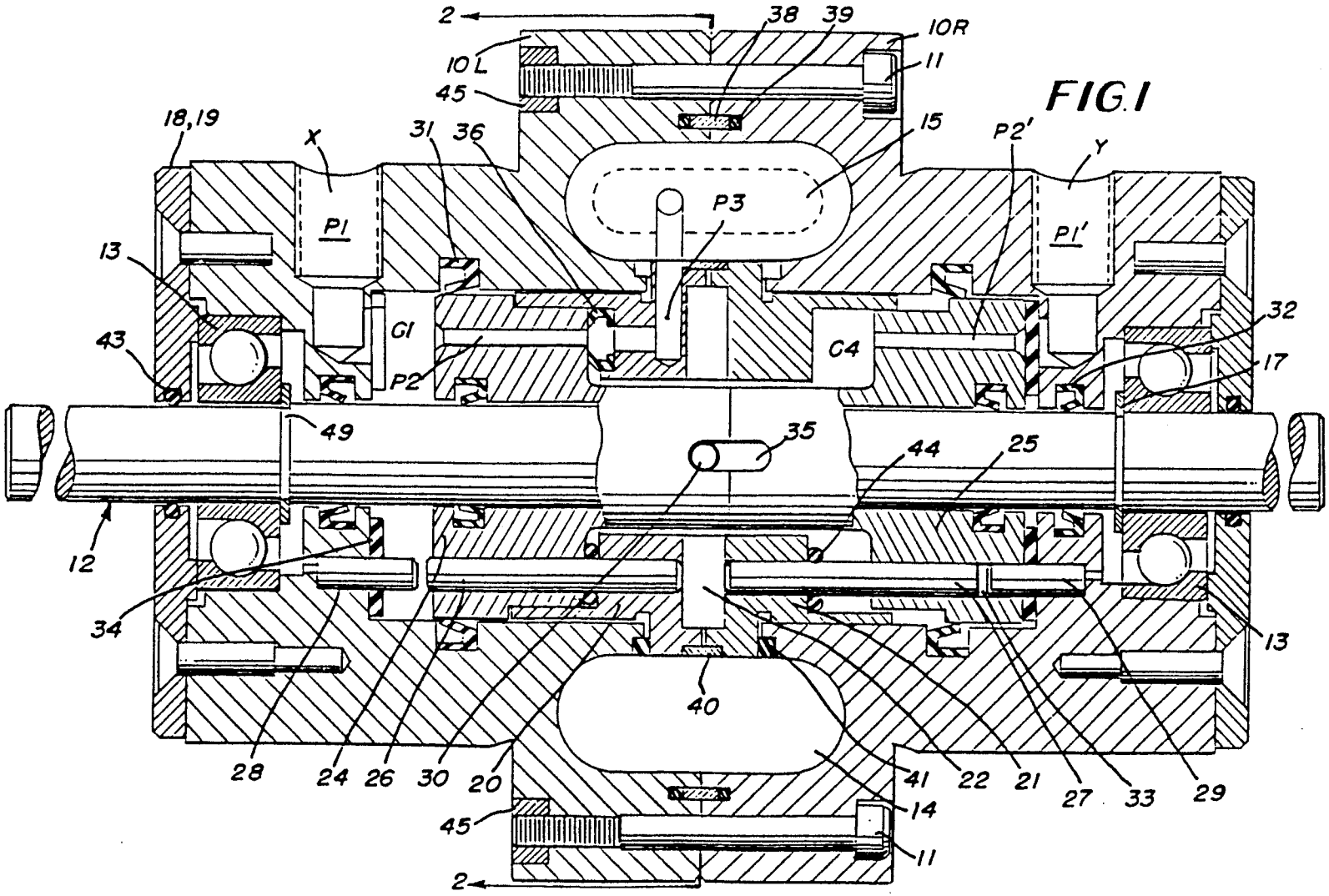
FIG. 1 illustrates a longitudinal, partial sectional view of a preferred embodiment of the indexing rotary actuator of the present invention taken along lines 1—1 of FIG. 2.
Figure 2:
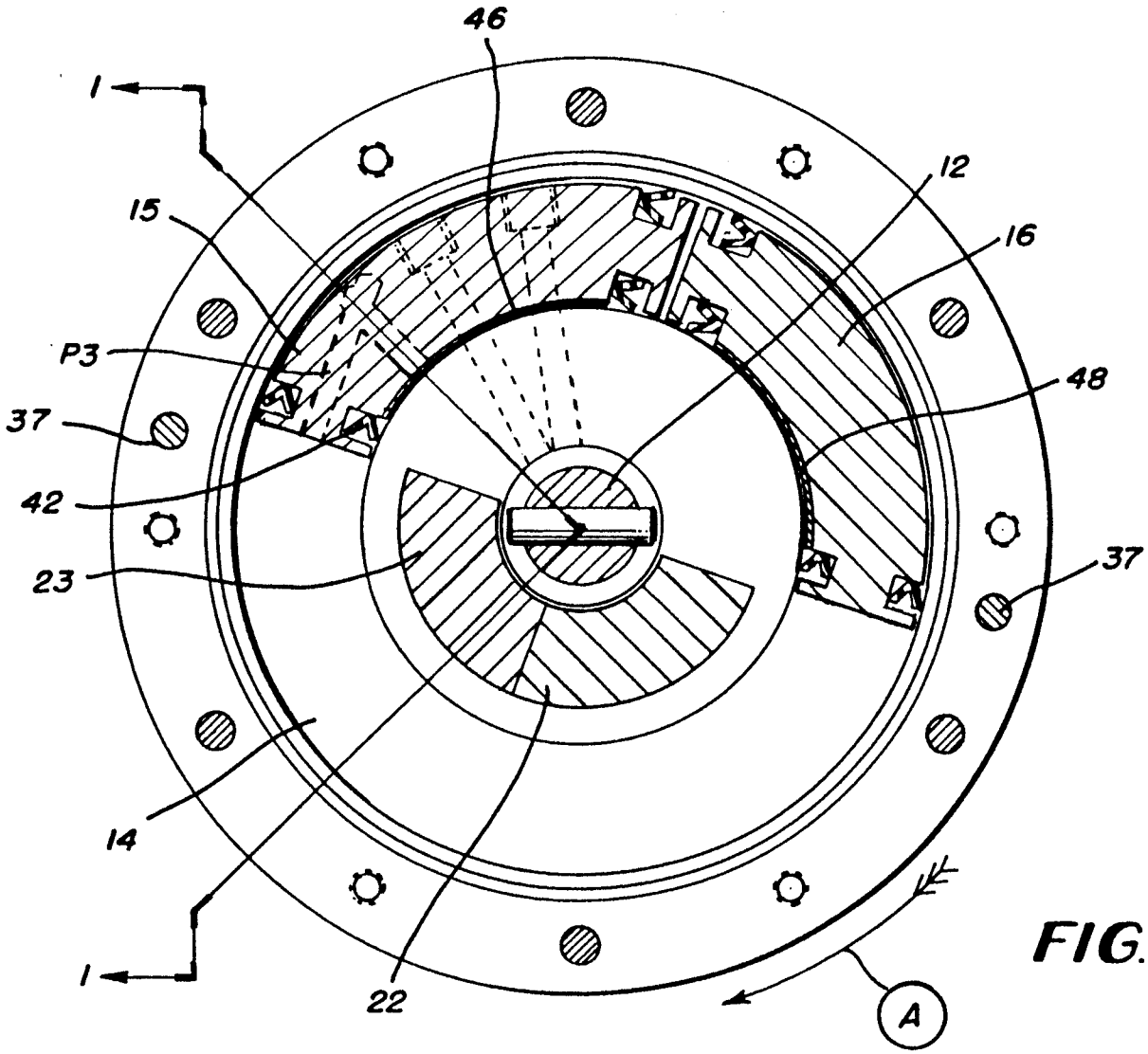
FIG. 2 is a cross-sectional view of the indexing rotary actuator taken along lines 2—2 of FIG. 1.

FIGS. 1 and 2 generally illustrate a preferred embodiment of the rotary actuator of the present invention. As illustrated in FIG. 1, the circular actuator housing comprises identical symmetric indexer body halves 10L and 10R mated together via machine screws 11 and nuts 45. Dowels 37, illustrated as disposed within an outer circumference of the indexer body half 10L, provide further stability along the outer housing of the rotary actuator. Shaft 12 is rotatable along the central axis of the circular actuator housing as supported by bearings 13. External retaining rings 17 mounted within groove 49 of shaft 12 locate the inner race of bearings 13. Bearing retainers 18 and pre-load shims 19 locate the outer race of bearings 13. Lubrication O-ring seal 43 provides a seal between shaft 12 and bearing retainer 18. As mounted together, indexer body halves 10L and 10R partially form an annular main piston chamber 14, around which arcuate pistons 15 and 16 are rotated about the central axis of the circular actuator housing to effect rotation of shaft 12. Pilot ring 38 is placed within an annular groove formed in an outer circumference of the joined indexer body halves 10L and 10R along with pilot O-rings 39. Pilot ring 38 provides concentric support for the circular rotary indexer housing.

Pistons 15 and 16 are fixedly mounted on respective piston mounting rings 20 and 21 via shims 46 and 48, illustrated in FIG. 2. The shims 46 and 48 are sandwiched between the pistons and the piston mounting rings and are formed to include screw holes and a passageway. The gap created by the shim prevents the piston from locking down on the indexer body halves 10L and 10R. The shims 46 and 48 are preferably metal, but may be any other suitable material including brass.

Piston mounting ring 20 is illustrated in greater detail in FIGS. 5*a*–5*d*, and as also illustrated in FIGS. 1 and 2, is manufactured to include a 90° raised, arcuate sector. Specifically, piston 15 is affixed to an outer peripheral surface of piston mounting ring 20 via shim 46. Arcuate sector 22 is formed as a raised portion on a first face of piston mounting ring 20. Similarly, piston 16 is affixed to an outer peripheral surface of piston mounting ring 21 via shim 48 and arcuate sector 23 is formed as a raised portion on a first face of piston mounting ring 21. The arcuate sectors are formed on a respective portion of the first faces of the piston mounting rings diametrically opposed to the area of the outer peripheral surfaces of the rings where the pistons are affixed thereto. The first faces of the piston mounting rings are mounted adjacent each other within indexer body halves 10L and 10R so that arcuate sectors 22 and 23 oppose each other, limiting rotation of shaft 12 through a range of 180° per index, as will be described further.

The piston mounting rings also include a passageway P3, shown in detail in piston mounting ring 20 of FIG. 5*a*–5*d*. Due to the 90° view portion of the rotary actuator of FIG. 1 along section 1—1 of FIG. 2, only passageway P3 of piston mounting ring 20 is illustrated. Piston mounting ring 21 includes passageway P3', which is not illustrated in FIG. 1, which leads from chamber C4 of indexer body half 10R to piston 16. The passageway P3 of piston mounting ring 20 of FIG. 4 leads from the second face of the piston mounting ring, which is opposite the first face which includes the arcuate sector, 90° out through the outside peripheral surface of the piston mounting ring to couple with the passageway of the respective piston.

Piston/piston mounting ring assemblies 15, 20 and 16, 21 are supported within indexer body halves 10L and 10R by integral radial plain bearings which are machined surfaces of the indexer body halves. The main piston chamber is formed by indexer body halves 10L and 10R and the outside peripheral surfaces of piston mounting rings 20 and 21. The main piston chamber 14 is sealed from the inner portion of indexer body halves 10L and 10R by cylinder chamber seals 40 and 41. Seal 40 is slightly wider (0.003"–0.005") than the gap provided by parts 20 and 21, so as to provide a slight preload (squeeze) upon assembly.

Clutch piston 24 is supported on piston/piston mounting ring assembly 15, 20 via dowel 26, which is press-fit into piston mounting ring 20. Similarly, clutch piston 25 is supported on piston/piston mounting ring assembly 16, 21 via dowel 27, which is press-fit into piston mounting ring 21. Dowels 28 and 29 are respectively press-fit into indexer body halves 10L and 10R. Clutch pistons 24 and 25 are slidably supported along the axis of shaft 12, a range of motion limited by main shaft dowel 30 is approximately 6 mm.

As illustrated in FIG. 1, clutch pistons 24 and 25 have been driven along shaft 12 to a right-most position within the clutch piston chamber. Accordingly, chamber C1 of indexer body half 10L is opened between clutch piston 24 and passageway P1. Chamber C4 of indexer body half 10R is defined by a variable distance between piston mounting ring 21 and clutch piston 25. In the alternative, when clutch pistons 24 and 25 are driven along shaft 12 to a left-most position within the clutch piston chamber, chamber C1 will be opened between piston mounting ring 20 and clutch piston 24 and chamber C4 will be opened between clutch piston 25 and passageway P1'. Chamber C1 and C4 of the clutch piston chamber are sealed via seals 31 and 32.

FIG. 6a–6d illustrate a clutch piston in greater detail, including dowel holes 33 formed therein through the base portion, offset from each other by 180° along an outer circumference of the circular base portion. Although not illustrated in FIG. 1, which is cut along section 1—1 of FIG. 2 to illustrate a 90° cutaway view of the rotary actuator, the piston mounting rings 20 and 21 both respectively include second dowels press-fit thereto, offset from illustrated dowels 26 and 27 by 180° around an outer circumference of the piston mounting rings, to form respective dowel pairs. The dowel pairs protruding from each of the piston mounting rings 20 and 21 fit through the dowel holes 33 of the clutch piston. The clutch pistons 24 and 25 are slidably supported along the respective dowel pairs 26 and 27.

Similarly, second dowels 28 and 29 are respectively affixed to indexer body halves 10L and 10R. The dowels 28 and 29 are also insertable through dowel holes 33 of the clutch pistons 24 and 25 to lock the respective clutch piston to the indexer body half to prevent rotation of the clutch piston with shaft 12. As illustrated in FIG. 1, clutch piston 25 is locked to indexer body half 10R through dowel 29 and is stationary with respect to rotation around the central axis of the circular actuator housing. Clutch piston 24, however, is engaged with dowel pair 26 of piston mounting ring 20 and transfers rotational energy of piston 15 along the main piston chamber 14 to shaft 12. O-ring or quadring seals 44 are optionally affixed to the piston mounting rings near the dowel pairs extending therefrom.

Clutch pistons 24 and 25 each include a pair of elongated slots 35 formed in the cylindrical sidewall which cooperate with shaft dowel 30 to limit the movement of the clutch pistons 24 and 25 along shaft 12 and to translate rotational energy of the pistons 15 and 16 respectively from the piston mounting rings 20 and 21 to shaft 12. Elongated slots 35b and 35c, which comprise a pair of elongated slots 35, are illustrated respectively in FIGS. 6a and 6d which show front and rear views of a clutch piston . Clutch pistons 24 and 25 further each include respective passageways P2 and P2', as illustrated in FIG. 1. For example, passageway P2 leads from chamber C1/passageway P1 of indexer body half 10L through clutch piston 24 to passageway P3 formed through piston mounting ring 20. Passageway P3 extends further into piston 15 to permit fluid to flow from external port X, through passageways P2 and P3 and through piston 15, to main piston chamber 14. As described previously, due to the 90° cutaway view along section 1—1, only passageway P3 through the piston mounting ring 20 is illustrated in FIG. 1, passageway P3' through piston mounting ring 21 is not illustrated.

Figure 3:
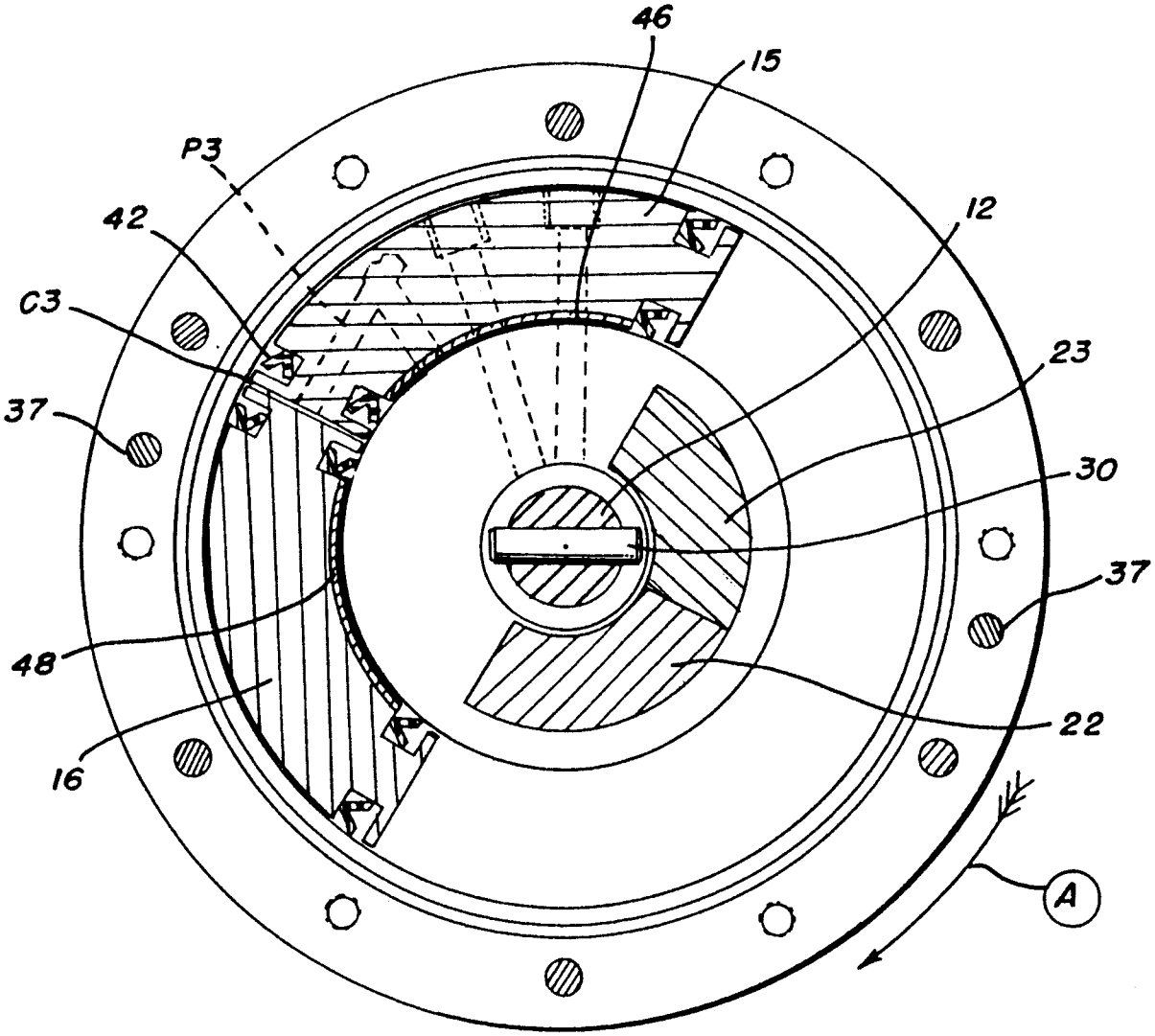
FIG. 3 is a cross-sectional view of the indexing rotary actuator of the FIG. 1 embodiment of the present invention wherein the pistons are located within the main piston chamber at a reference position prior to indexing.

Operation of the rotary actuator of the present invention will now be described. A fluid powered rotary actuator will be described in this embodiment although the rotary actuator of the present invention may be air powered. The description will begin by assuming that clutch pistons 24 and 25 are located within the clutch piston chamber along shaft 12 at a left-most position, which is considered the reference position for purposes of description. Accordingly, shaft dowel 30 of shaft 12 is engaged with the elongate slots of clutch piston 25. The dowel 28 of indexer body half 10L therefore protrudes within dowel hole 33 of clutch piston 24 to lock clutch piston 24 stationary to indexer body half 10L. Piston 15 within main piston chamber 14 is in the reference position as illustrated in FIG. 3, which is the same position of the piston as shown in FIG. 2. For purposes of description, piston 16 is located in FIG. 3 at a reference position 180° from its position in FIG. 2. Arrow A indicates the direction of rotation of pistons 15 and 16 within main piston chamber 14. Therefore, the rear face of piston 15, which includes the exit opening of passageway P3, is adjacent the lead face of piston 16, with smaller chamber portion C3 of main piston chamber 14 formed therebetween. The larger chamber portion C2 of main piston chamber 14, approximately equal to 180° of diameter around the rotary actuator, is formed between the lead face of piston 15 and the rear face of piston 16.

As illustrated by arrow A, the direction of rotation of the pistons 15 and 16, and thus shaft 12 and shaft dowel 30, is clockwise. Furthermore, in the reference position illustrated in FIG. 3, arcuate sector 23 of piston mounting ring 21 is rotated through 180° from the position illustrated in FIG. 2. The front face of arcuate sector 23 is abutted against the rear face of arcuate sector 22 of piston mounting ring 20. In this reference position illustrated in FIG. 3, both arcuate sectors 22 and 23 would not be visible in FIG. 1. However, piston 16 would be visible in the bottom portion of main piston chamber 14 of FIG. 1, in addition to piston 15 visible in the upper portion of the main piston chamber.

Clutch piston bumpers 34 are mounted on the indexer body halves 10L and 10R within the clutch piston chamber. Accordingly, a small gap of chamber C1 exists between indexer body half 10L and clutch piston 24 when clutch piston 24 is in the left-most position. With clutch pistons 20 and 21 located within the clutch piston chamber at the left-most position and piston 16 located at the reference position as shown in FIG. 3, an indexing operation of the rotary actuator to rotate the shaft 12 through a range of 180° begins as pressurized fluid enters port X of indexer body half 10L. As the pressurized fluid is forced into the small gap of chamber C1 between the indexer body half 10L and clutch piston 24 formed by clutch piston bumper 34, the gap fills with fluid. As the pressure increases, clutch piston 24 slides along dowel pair 26 of piston mounting ring 20 and shaft 12 to the right thereby disengaging from dowel 28. The fluid pressure drives clutch piston 24 to the right, which in turn drives clutch piston 25 to the right within chamber C4 of the clutch piston chamber of indexer body half 10R. Clutch piston 25 is slidably supported along dowel pair 27. Under increasing fluid pressure, elongate slots 35 of clutch piston 24 engage fully against main dowel 30 of shaft 12. As a result, clutch piston 25 is abutted against clutch piston bumpers 34 of indexer body half 10R. Clutch piston 25 is locked in a stationary manner to indexer body half 10R via dowel 29. Clutch pistons 24 and 25 are therefore located within the clutch piston chamber at the right-most position, as illustrated in FIG. 1.

When clutch pistons 24 and 25 assume the right-most position within the clutch piston chamber, the pressurized fluid begins to flow through the passageway P2 of clutch piston 24 and through seal 36, to passageway P3 of piston mounting ring 20, which leads into the passageway P3 of piston 15, which is illustrated in further detail in FIGS. *7a–7b*. With reference to FIG. 3, the pressurized fluid exits passageway P3 of piston 15 and enters into small gap C3 in the main piston chamber 14. Piston seals 42 prevent leakage of pressurized fluid between the pistons and the outer peripheral surface of the piston mounting rings. As the volume of pressurized fluid increases, piston 15 begins to rotate around the central axis of the circular actuator housing. As the piston 15 rotates, piston mounting ring 20 rotates, which rotates clutch piston 24 coupled thereto via dowel pair 26, to rotate shaft 12 via shaft dowel 30.

As piston 15 rotates clockwise, fluid in large chamber portion C2 between the front face of piston 15 and the rear face of piston 16 is forced out of the main piston chamber 14 through passageway P3′ of piston 16, which is not illustrated. The excess fluid is forced through passageway P3′ of piston 16 and piston mounting ring 21, through chamber C4 of indexer body half 10R and into passageway P2′ of clutch piston 25. The forced fluid then passes through passageway P1′ of indexer body half 10R out port Y. As fluid volume into port X of indexer body half 10L increases to further rotate piston 15 around main piston chamber 14, the remaining fluid in chamber portion C2 is forced out port Y of indexer body half 10R.

Figure 4:
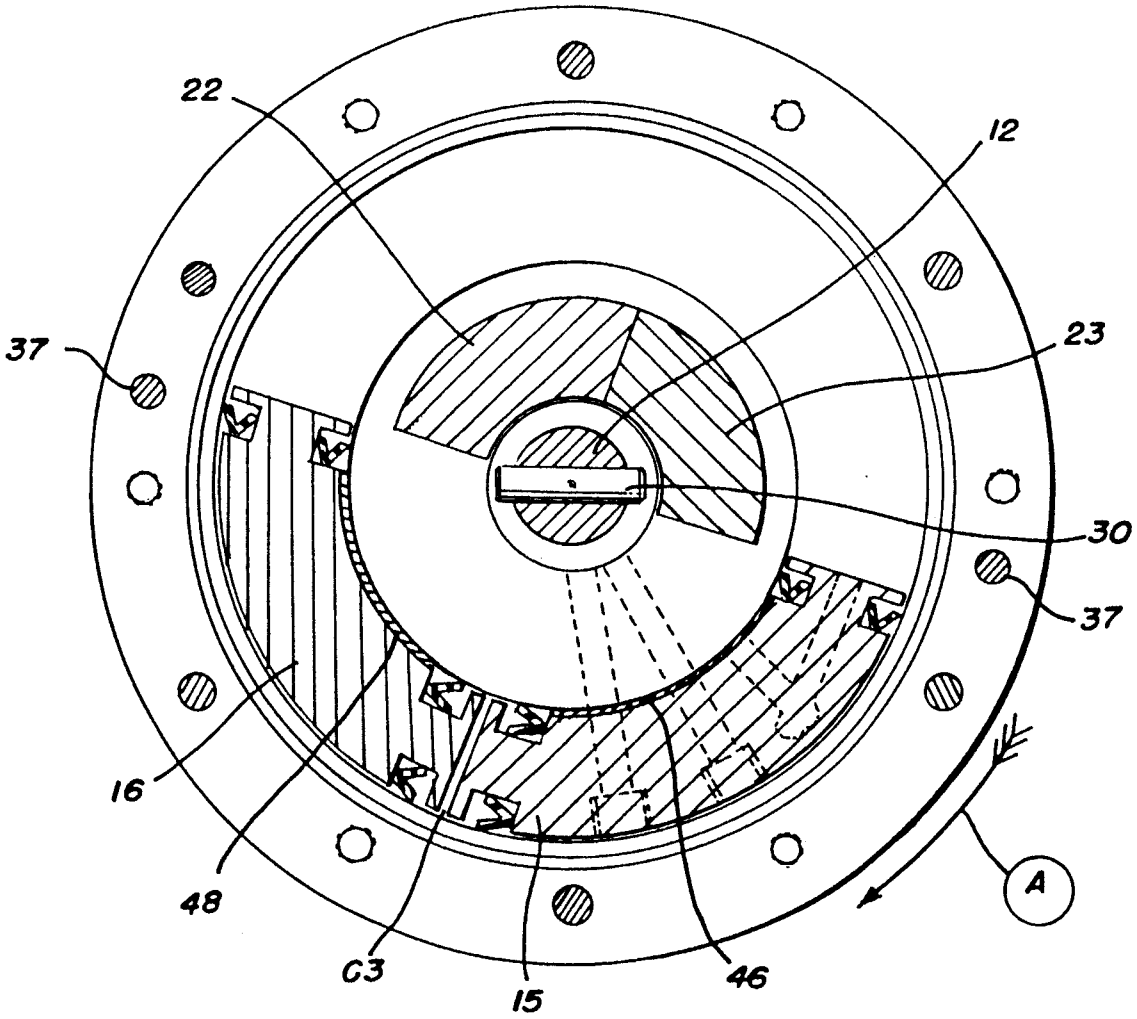
FIG. 4 is a cross-sectional view of the indexing rotary actuator of the FIG. 1 embodiment of the present invention wherein the pistons are rotated within the main piston chamber after an indexing operation.
Figure 5A:
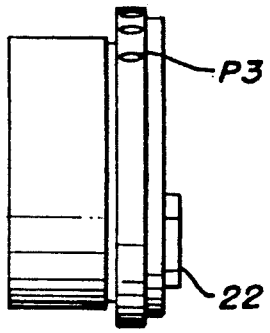
FIG. 5*a* illustrates a first side view of a piston mounting ring of the indexing rotary actuator.
Figure 5B:
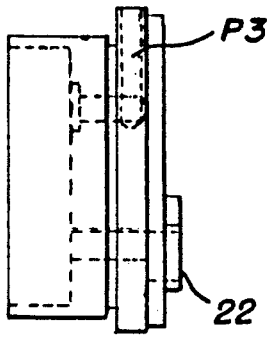
FIG. 5*b* illustrates a second side view of a piston mounting ring of the indexing rotary actuator.
Figure 5C:
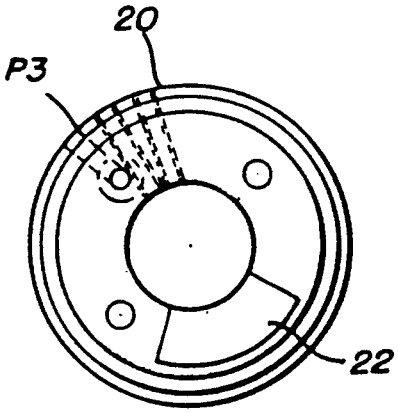
FIG. 5*c* is a view of a first face of the piston mounting ring of FIG. 5*a;*
Figure 5D:
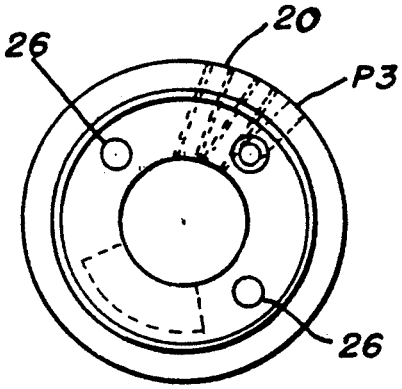
FIG. 5*d* is a view of a second face of the piston mounting ring of FIG. 5*a;*
Figure 6A:
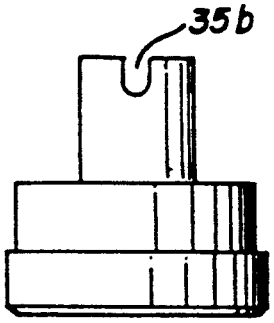
FIG. 6*a* is a front view of a clutch piston of the indexing rotary actuator of the present invention.
Figure 6D:
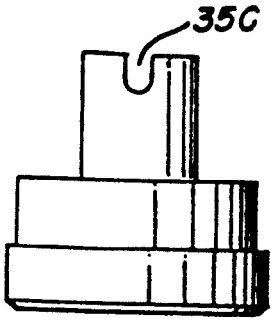
FIG. 6*d* is a rear view of a clutch piston of the indexing rotary actuator of the present invention.
Figure 6B:
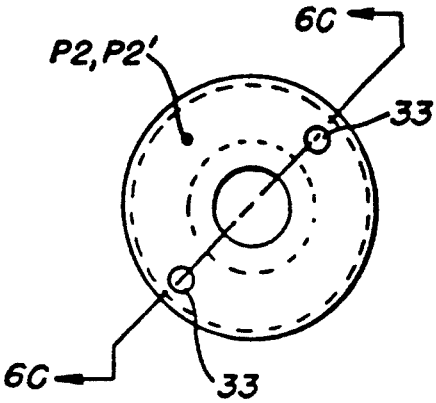
FIG. 6*b* is a plane view of the first face of the clutch piston of FIG. 6*a;*
Figure 6C:
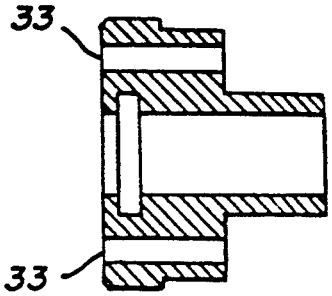
FIG. 6*c* is a cross-sectional view of the clutch piston of FIG. 6*a;*
Figure 7A:
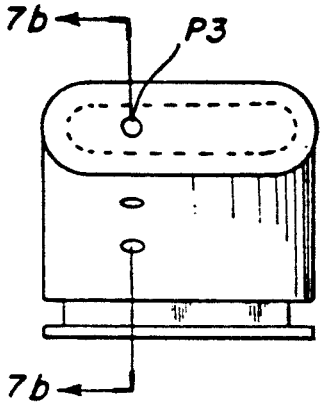
FIG. 7*a* is a view of a main piston of the indexing rotary actuator.
Figure 7B:
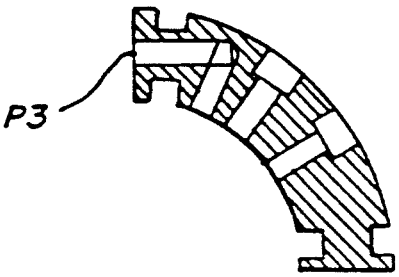
FIG. 7*b* is a partial sectional view taken along lines 7*b*—7*b* of FIG. 7*a*.

As piston 15 rotates clockwise in the direction of arrow A, arcuate sector 22 of piston mounting ring 20 rotates clockwise around the shaft center line. Eventually, the front face of arcuate sector 22 will rotate around the central axis of the circular actuator housing 180° to abut against the rear face of arcuate sector 23 of piston mounting ring 21. Piston mounting ring 21, which is affixed to piston 16, is coupled to clutch piston 25 through dowel pair 27. In the right-most position as illustrated in FIG. 1, dowel 29 of indexer body half 10R is engaged through dowel hole 33 of clutch piston 25, locking clutch piston 25 to indexer body half 10R so that clutch piston 25 cannot rotate. Accordingly, as the front face of arcuate sector 22 of piston mounting ring 20 abuts the rear face of arcuate sector 23 of piston mounting ring 21, rotation of piston 15 is stopped. At the completion of the indexing, piston 16 remains in the reference position of FIG. 3 while piston 15 is rotated around the shaft center line 180° to a position immediately behind piston 16, as illustrated in FIG. 4. Arcuate sectors 22 and 23 effectively limit the index of rotation of pistons 15 and 16, thus limiting the index of rotation of shaft 12 to 180°.

The above operation is descriptive of indexing of the shaft 180° resulting in rotation of the pistons 15 and 16 to positions within the main piston chamber 14 as illustrated in FIG. 3. A following indexing operation to rotate piston 16 180° around main piston chamber 14 to a position where the front face of piston 16 abuts against the rear face of piston 15 operates similar to that described above, but in the reverse direction. Specifically, as clutch pistons 24 and 25 are located at the right-most position within the clutch piston chamber as illustrated in FIG. 1, pressurized fluid is applied to external port Y to force clutch piston 25 in a direction toward indexer body half 10L. The pressurized fluid is forced through passageways P3′ of piston mounting ring 21 and piston 16, which are not illustrated, to drive piston 16 in a clockwise direction around main piston chamber 14. Accordingly, successive indexing operations are performed by alternately applying pressurized fluid to external ports X and Y. Thus, this embodiment of the present invention requires no reciprocation to reset the indexing rotary actuator. Efficiency is therefore increased as compared to the above described conventional actuators which require a full return stroke in which no work is performed. Furthermore, since the angle of rotation of output shaft 12 is accurately controlled there is no cumulative error with respect to shaft rotation over successive indexing operations.

During rotation of pistons 15 and 16 within main piston chamber 14, variable frictional drag occurs due to the pressurized fluid within main piston chamber 14 acting on the outer peripheral surfaces of piston mounting rings 20 and 21. As the angle of rotation of pistons 15 and 16 is increased from 0° to 180°, a radial proportion of the outer peripheral surfaces of the piston mounting rings 20 and 21 are uncovered and exposed to pressurized fluid within the main piston chamber 14. The resulting force due to the pressurized fluid is the product of the pressure (force per unit area) and the effective area, which in this case increases linearly during rotation of the pistons 15 and 16. As a result, frictional drag linearly increases as the pistons 15 and 16 complete a stroke, thereby creating frictional torque. The resulting force acts through the center of the effective area and produces a moment (a torque) and load that effects the piston/piston mounting ring assemblies 15, 20 and 16, 21 since the resulting force acts off center (eccentric) to the radial plain bearing which supports the total load and moment. The greater the load, the greater the frictional torque to resist rotational motion. The frictional torque acts inversely to the acceleration that a normal mass would experience under a constant force, which is the case since the fluid pressure normally stays constant. As the pressurized fluid accelerates the pistons 15 and 16 around the main piston chamber 14, the pressurized fluid pushing down on the piston mounting rings 20 and 21 decelerates the pistons 15 and 16. Therefore, the present invention has an inherent design mechanism for speed control. Furthermore, due to the absence of any cushioning device contacting the piston face, as is common in many rotary actuators, 100% torque is available at the beginning of the rotational stroke. Since cushioning devices are not included as contacting the piston face, the effective piston area is not reduced as in common rotary actuators.

An advantage of the indexing rotary actuator of the present invention as described above is that the indexer body halves 10L and 10R may be disassembled by removing machine screws 11 and nuts 45. Accordingly, the interior of the indexing rotary actuator including shaft 12, piston mounting rings 20 and 21, clutch pistons 24 and 25 and pistons 15 and 16 can be easily disassembled or repaired once removed from the housing. Furthermore, since the indexer body halves 10L and 10R and clutch pistons 24 and 25 are identical and symmetric, and since pistons 15 and 16 and piston mounting rings 20 and 21 are also symmetrical and identical except for screw mounting holes and threads and air passages, efficiency of mass production of the indexing rotary actuator of the present invention is optimized.

The above described embodiment of the present invention may be varied in many ways. For instance, the mechanism providing clutching of the clutch pistons to shaft 12 and the indexer body halves is not limited to the slot and dowel configuration illustrated. Splines and polygons may be utilized to provide clutching, however this alternative clutching method does not produce tolerances as close to those achieved using the slot and dowel configuration. Also, the arcuate piston cross-section is not limited to the shape illustrated since any practical cross-section which can effectively be sealed may be used. Magnetic coupling can be utilized between the arcuate piston with respect to the shaft and indexer body halves. However, use of magnetic coupling creates several design problems with respect to fluid porting and piston sealing. Additionally, the indexing body halves may be of symmetric square shape rather than symmetric circular shape. Also, the angle through which the raised arcuate sectors extend may vary, thus varying the angle of rotation of the shaft.

In the preferred embodiment, the seals and O-rings are preferably made of Buna. However, sealing of the compressed air or fluid is not limited to the seals and materials as described, any suitable synthetic rubber may be used. The indexer body halves 10L and 10R, pistons 15 and 16 and pilot ring 38 are preferably made of aluminum. The clutch piston bumpers are preferably made of Buna. The cylinder chamber seals are preferably teflon. Piston mounting rings 20 and 21, clutch pistons 24 and 25, shaft 12, ball bearings 13, external retaining rings 17 and bearing retainers 18, and the dowels are preferably steel. The above designated materials are not to be considered limiting as suitable variations are to be considered within the scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is

1. An indexing rotary actuator for unidirectionally rotating an output shaft through a specific angle of rotation per each indexing operation, comprising:

an annular main piston chamber;

first and second main pistons rotatable around a central axis of the indexing rotary actuator through said annular main piston chamber;

a clutch piston chamber disposed parallel to the central axis of the indexing rotary actuator within a central portion thereof; and first and second clutch pistons disposed within said clutch piston chamber slidably supported along the output shaft, said first and second clutch pistons operatively coupled to said first and second main pistons respectively via first and second mounting piston rings, said first and second clutch pistons movable in both directions along the output shaft to respectively engage and disengage rotational movement of said first and second main pistons to the output shaft.

2. An indexing rotary actuator, having an output shaft rotatable in a single direction about a central axis of the indexing rotary actuator through a specific angle per each indexing, comprising:

a pair of symmetrical housing members mounted together to form an actuator housing, the output shaft extending through opposite first and second ends of said actuator housing along the central axis of the indexing rotary actuator, said actuator housing including therein a main piston chamber disposed annularly about the central axis of the indexing rotary actuator along an outer circumference of said actuator housing, and a clutch piston chamber disposed along the central axis of the indexing rotary actuator within a central portion of said actuator housing including the output shaft;

first and second main pistons rotatable around the central axis of the indexing rotary actuator within said main piston chamber;

first and second piston mounting rings mounted within said clutch piston chamber with respective first faces opposing each other, the output shaft extending through central portions of said first and second piston mounting rings, said first and second main pistons respectively being affixed to outer peripheral surfaces of said first and second piston mounting rings to be rotatable within said clutch piston chamber around the central axis of the indexing rotary actuator, said first and second piston mounting rings respectively including second faces opposite said first faces;

first and second clutch pistons respectively mounted within said clutch piston chamber opposing said second faces of said first and second piston mounting rings, said first and second clutch pistons respectively being slidably supported within said clutch piston chamber along the output shaft toward and away from said first and second piston mounting rings to be engaged and disengaged with said first and second piston mounting rings; and fluid drive means, operatively coupled to said first and second main pistons respectively through said first and second piston mounting rings and said first and second clutch pistons, for alternately driving said first and second main pistons around said main piston chamber, rotational movement of said first and second main pistons being translated to the output shaft respectively via said first and second piston mounting rings and said first and second clutch pistons, said first and second piston mounting rings including respective first and second raised arcuate sectors formed upon said first faces which cooperate to limit rotation of said first and second main pistons around the central axis of the indexing rotary actuators thus limiting rotation of the output shaft in a single direction through the specific angle per each indexing.

3. The indexing rotary actuator of claim 2, wherein said raised arcuate sectors are each formed as 90° sectors around said first and second piston mounting rings.

4. The indexing rotary actuator of claim 3, wherein the specific angle is 180°.

5. The indexing rotary actuator of claim 2, wherein said fluid drive means comprises respective fluid passageways extending through said first and second clutch pistons, said first and second piston mounting rings and said first and second main pistons which provide fluid paths from said clutch piston chamber through said first and second main pistons to said main piston chamber, said actuator housing comprising respective first and second inlet ports, disposed within said first and second ends of said actuator housing, to provide external fluid flow to and from the indexing rotary actuator, said first and second main pistons being driven within said main piston chamber in response to application of pressurized fluid respectively into said first and second inlet ports.

6. The indexing rotary actuator of claim 2, wherein the output shaft comprises a shaft dowel passing therethrough, said first and second clutch piston each including a pair of slots formed within cylindrical sidewalls of said first and second clutch pistons, said shaft dowel of the output shaft being engageable with said slots to limit slidable motion of said first and second clutch pistons along the output shaft and to couple the rotational energy of said first and second main pistons respectively through said first and second piston mounting rings to the output shaft.

7. The indexing rotary actuator of claim 6, wherein said first and second clutch pistons each comprise:

a clutch piston annular base portion including a central shaft hole through which the output shaft slidably passes therethrough, a first face of said clutch piston annular base portion opposing said first face of a respective one of said first and second piston mounting rings;

a tapered cylindrical portion extending from said first face of said clutch piston annular base portion, said pair of slots being formed within cylindrical sidewalls of an end of said tapered cylindrical portion away from said clutch piston annular base portion;

a pair of dowel holes formed within an outer circumference of said clutch piston annular base portion parallel to the output shaft and spaced apart from each other 180°; and a first fluid passageway formed through the outer circumference of said clutch piston annular base portion parallel to the output shaft and disposed between said pair of dowel holes separated therefrom by a 90° angle.

8. The indexing rotary actuator of claim 7, wherein said first and second piston mounting rings each comprise:

a mounting ring annular base portion including a central shaft hole through which the output shaft is inserted to be rotatable therein, said mounting ring annular base portion comprising said first and second faces of said piston mounting rings;

a first pair of dowels affixed to and extending from said second face parallel to the output shaft and spaced apart from each other 180°, said first pair of dowels inserted within said pair of dowel holes of a respective one of said first and second clutch pistons which are slidably supported along said first pair of dowels; and a second fluid passageway, extending from said second face within said mounting ring annular base portion parallel to the output shaft, and further extending 90° outward the outer peripheral surface to a respective one of said first and second main pistons, said second passageway operatively coupled to said first fluid passageway of a respective one of said first and second clutch pistons when engaged therewith.

* * * * *